US006383319B1

(12) United States Patent
Humble et al.

(10) Patent No.: US 6,383,319 B1
(45) Date of Patent: May 7, 2002

(54) ROCKET FUELS BASED ON METAL HYDRIDES AND POLY-DCPD

(75) Inventors: Ronald W. Humble, Colorado Springs, CO (US); Robert H. Grubbs, South Pasadena, CA (US); Charles S. Woodson, Conroe, TX (US)

(73) Assignee: A.P.T. Aerospace, L.L.C., Monroe, LA (US)

( * ) Notice: Subject to any disclaimer, the term of this patent is extended or adjusted under 35 U.S.C. 154(b) by 0 days.

(21) Appl. No.: 09/369,051

(22) Filed: Aug. 4, 1999

Related U.S. Application Data

(60) Provisional application No. 60/095,667, filed on Aug. 7, 1998.

(51) Int. Cl.[7] ..... C06B 27/00

(52) U.S. Cl. ..... 149/87; 149/109.2; 44/354

(58) Field of Search ..... 44/354, 457, 459, 44/628; 149/87, 109.2

(56) References Cited

U.S. PATENT DOCUMENTS

| | | | | |
|---|---|---|---|---|
| 3,242,667 | A | 3/1966 | Kidwell et al. | 60/35.4 |
| 3,783,054 | A | 1/1974 | Marlett et al. | 149/109 |
| 4,883,851 | A | 11/1989 | Grubbs et al. | 526/268 |
| 4,945,144 | A | 7/1990 | Grubbs et al. | 526/268 |
| 5,296,566 | A | 3/1994 | Brown-Wensley | 526/171 |
| 5,312,940 | A | 5/1994 | Grubbs et al. | 556/136 |
| 5,342,909 | A | 8/1994 | Grubbs et al. | 526/171 |
| 5,710,298 | A | 1/1998 | Grubbs et al. | 556/22 |
| 5,728,917 | A | 3/1998 | Grubbs et al. | 585/653 |
| 5,831,108 | A | 11/1998 | Grubbs et al. | 556/21 |
| 5,849,851 | A | 12/1998 | Grubbs et al. | 526/93 |
| 5,917,071 | A | 6/1999 | Grubbs et al. | 556/21 |

FOREIGN PATENT DOCUMENTS

| | | | |
|---|---|---|---|
| WO | WO 97/20865 | 6/1997 | C08F/4/80 |
| WO | WO 97/29135 | 8/1997 | C08F/4/80 |

OTHER PUBLICATIONS

Humble, R.W., et al., "Solid Rocket Motors," Chapter 6, Space Propulsion Analysis and Design, McGraw–Hill, Inc., 1995, pp. 295–363.

Humble, R.W., et al., "Solid Rocket Motors," Chapter 7, Space Propulsion Analysis and Design, McGraw–Hill, Inc., 1995, pp. 365–441.

*Primary Examiner*—Margaret Medley
(74) *Attorney, Agent, or Firm*—Pillsbury Winthrop LLP; Tanuja V. Garde

(57) ABSTRACT

Preferred embodiments of the present invention relate to rocket fuels comprising metal hydrides and poly-dicyclopentadiene ("poly-DCPD"). Although poly-DCPD also has physical and chemical properties that are compatible with being used as a rocket fuel in its own right, its primary function is as a binder for the metal hydride. Illustrative examples of metal hydrides include but are not limited to as aluminum hydrides, lithium hydrides, and lithium aluminum hydrides.

11 Claims, 5 Drawing Sheets

ROCKET FUELS BASED ON METAL HYDRIDES AND POLY-DCPD

This application claims the benefit of provisional application No. 60/095,667, filed Aug. 7, 1998.

BACKGROUND

A rocket is a prototypical example of a propulsion system that accelerates matter to provide a force of thrust that moves a vehicle, or rotates matter about its center of mass. Primarily used for space propulsion, rocket systems may be classified by the type of propellant that is used: (i) liquid rocket propulsion systems ("LRPSs"); (ii) solid rocket motors ("SRMs"); and (iii) hybrid rocket propulsion systems ("HRPSs"). As its name implies, the hybrid rocket propulsion system uses both a liquid propellant and a solid propellant.

Hydrogen is one of the best rocket fuels for any system. Unfortunately, hydrogen is quite difficult to handle. At standard temperature and pressure, hydrogen is a gas and the size of the storage tanks necessary to store the gaseous hydrogen is generally impractical for many rocket systems. Alternatively, hydrogen may be stored as a liquid which will reduces the size of the storage tanks. However, expensive and complicated cryogenics equipment is necessary to maintain the hydrogen in the liquid state. Because of the difficulties in handling and storage of pure hydrogen, most rocket fuels are now hydrogen-containing compounds, particularly hydrocarbons, which do not have the associated handling difficulties. Unfortunately, these alternative fuels also do not have many of the desirable characteristics of pure hydrogen. As a result, despite the availability of a variety of rocket fuels, a need exists for rocket fuels that are easy to handle and have the desirable characteristics of pure hydrogen.

SUMMARY

The present invention relates to novel rocket fuels. More particularly, the present invention relates to the use of metal hydride rocket fuels and methods for making the same. In particularly preferred embodiments, the present invention relates to rocket fuels comprising metal hydrides and polydicyclopentadiene ("poly-DCPD"). Although poly-DCPD also has physical and chemical properties that are compatible with being used as a rocket fuel in its own right, its primary function is as a binder for the metal hydride. Illustrative examples of metal hydrides include but are not limited to aluminum hydrides, lithium hydrides, and lithium aluminum hydrides.

DETAILED DESCRIPTION OF THE PREFERRED EMBODIMENTS

Figure 1:
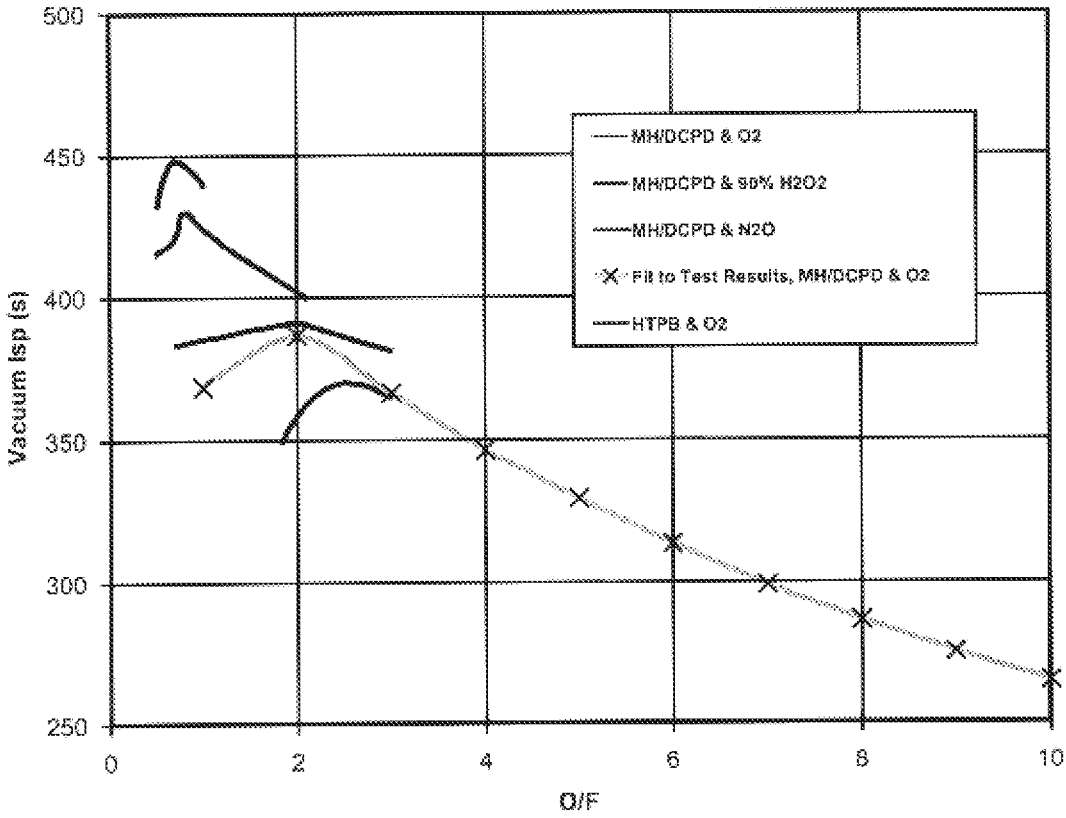
FIG. 1 is a graphical representation of the specific impulse of $Li_3AlH_6$ and both oxygen and hydrogen peroxide as a function of mixture ratio.

The present invention relates to the use of metal hydride rocket fuels and methods for making the same. In general, the present invention relates to rocket fuels comprising metal hydrides and a polymer derived from ring-opening metathesis polymerization ("ROMP") reaction. Illustrative examples of metal hydrides include but are not limited to aluminum hydrides, lithium hydrides, and lithium aluminum hydrides. In preferred embodiments, the metal hydride is selected from the group consisting of $AlH_3$, $LiAlH_3$, and $Li_3AlH_6$. The use of $Li_3AlH_6$ is particularly preferred.

The use of metal hydrides as rocket propellants, particularly aluminum hydride ($AlH_3$) and beryllium hydride ($BeH_2$) have been briefly explored. However, because hydrides readily react with moisture and ambient gases, hydrides must be handled and stored with special care. In addition, hydrides also react with most conventional propellant binders. Typically, binders are long-chain polymers that hold the solid propellant (usually powders or crystals) in place by forming a continuous matrix through polymerization and cross-links. As a result, despite the physical and chemical characteristics that show promise as a rocket fuel, the use of metal hydrides as rocket fuels has not been practical and/or commercially feasible.

The use of ROMP-based polymers as binders for metal hydrides solves many of the problems associated with the use of metal hydrides as rocket fuels. The ROMP-based polymer provides an inert structural framework for holding the solid metal hydrides. The ROMP polymer possesses sufficient structural strength for withstanding the variations in temperature, pressure, and acceleration associated with space flights. Moreover, metal hydrides are insoluble in the cyclic monomer and remain inert as the monomers are polymerized during the ROMP reaction.

Although any metathesis catalyst may be used for the ROMP reaction, ruthenium and osmiium catalysts as described by U.S. Pat. Nos. 5,342,940, 5,849,851, 5,831,108, and 5,917,071 (which are all incorporated herein by reference) are particularly preferred. Briefly, the catalysts are of the general formula

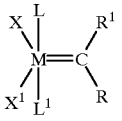

wherein:

M is ruthenium or osmium;

X and $X^1$ are each independently any anionic ligand;

L and $L^1$ are each independently any neutral electron donor ligand;

R and $R^1$ are each independently hydrogen or a substituent selected from the group consisting of $C_1$–$C_{20}$ alkyl, $C_2$–$C_{20}$ alkenyl, $C_2$–$C_{20}$ alkynyl, aryl, $C_1$–$C_{20}$ carboxylate, $C_1$–$C_{20}$ alkoxy, $C_2$–$C_{20}$ alkenyloxy, $C_2$–$C_{20}$ alkynyloxy, aryloxy, $C_2$–$C_{20}$ alkoxycarbonyl, $C_1$–$C_{20}$ alkylthio, $C_1$–$C_{20}$ alkylsulfonyl and $C_1$–$C_{20}$ alkylsulfinyl. Optionally, each of the R or $R^1$ substituent group may be substituted with one or more moieties selected from the group consisting of $C_1$–$C_{10}$ alkyl, $C_1$–$C_{10}$ alkoxy, and aryl which in turn may each be further substituted with one or more groups selected from a halogen, a $C_1$–$C_5$ alkyl, $C_1$–$C_5$ alkoxy, and phenyl. Moreover, any of the catalyst ligands may further include one or more functional groups. Examples of suitable functional groups include but are not limited to: hydroxyl, thiol, thioether, ketone, aldehyde, ester, ether, amine, imine, amide, nitro, carboxylic acid, disulfide, carbonate, isocyanate, carbodiimide, carboalkoxy, carbamate, and halogen.

In preferred embodiments of these catalysts, the R substituent is hydrogen and the $R^1$ substituent is selected from the group consisting of $C_1$–$C_{20}$ alkyl, $C_2$–$C_{20}$ alkenyl, and aryl. In even more preferred embodiments, the $R^1$ substituent is phenyl or vinyl, optionally substituted with one or more moieties selected from the group consisting of $C_1$–$C_5$ alkyl, $C_1$–$C_5$ alkoxy, phenyl, and a functional group. In the most preferred embodiments, the $R^1$ substituent is phenyl or —C═C$(CH_3)_2$.

In preferred embodiments of these catalysts, L and $L^1$ are each independently selected from the group consisting of phosphine, sulfonated phosphine, phosphite, phosphinite, phosphonite, arsine, stibine, ether, amine, amide, imine, sulfoxide, carboxyl, nitrosyl, pyridine, and thioether. In more preferred embodiments, L and $L^1$ are each a phosphine of the formula $PR^3R^4R^5$, where $R^3$, $R^4$, and $R^5$ are each independently aryl or $C_1$–$C_{10}$ alkyl, particularly primary alkyl, secondary alkyl or cycloalkyl. In the most preferred embodiments, L and $L^1$ ligands are each selected from the group consisting of —P(cyclohexyl)$_3$, —P(cyclopentyl)$_3$, —P(isopropyl)$_3$, and —P(phenyl)$_3$.

In preferred embodiments of these catalysts, X and $X^1$ are each independently hydrogen, halide, or one of the following groups: $C_1$–$C_{20}$ alkyl, aryl, $C_1$–$C_{20}$ alkoxide, aryloxide, $C_3$–$C_{20}$ alkyldiketonate, aryldiketonate, $C_1$–$C_{20}$ carboxylate, arylsulfonate, $C_1$–$C_{20}$ alkylsulfonate, $C_1$–$C_{20}$ alkylthio, $C_1$–$C_{20}$ alkylsulfonyl, or $C_1$–$C_{20}$ alkylsulfinyl. Optionally, X and $X^1$ may be substituted with one or more moieties selected from the group consisting of $C_1$–$C_{10}$ alkyl, $C_1$–$C_{10}$ alkoxy, and aryl which in turn may each be further substituted with one or more groups selected from halogen, $C_1$–$C_5$ alkyl, $C_1$–$C_5$ alkoxy, and phenyl. In more preferred embodiments, X and $X^1$ are halide, benzoate, $C_1$–$C_5$ carboxylate, $C_1$–$C_5$ alkyl, phenoxy, $C_1$–$C_5$ alkoxy, $C_1$–$C_5$ alkylthio, aryl, and $C_1$–$C_5$ alkyl sulfonate. In even more preferred embodiments, X and $X^1$ are each halide, $CF_3CO_2$, $CH_3CO_2$, $CFH_2CO_2$, $(CH_3)_3CO$, $(CF_3)_2(CH_3)CO$, $(CF_3)(CH_3)_2CO$, PhO, MeO, EtO, tosylate, mesylate, or trifluoromethanesulfonate. In the most preferred embodiments, X and $X^1$ are each chloride.

In general, a solid rocket fuel of the present invention comprises a metal hydride (or a combination of metal hydrides) and a ROMP-based polymer. The inventive rocket fuel is formed by contacting a metathesis catalyst with a cyclic olefin (or a combination of cyclic olefins) in the presence of a metal hydride. These key ingredients may be added in any order. In preferred embodiments, the metal hydride is insolvable in the cyclic monomer.

The cyclic olefins may be strained or unstrained, monocyclic or polycyclic, may optionally include heteroatoms, and may include one or more functional groups. Suitable cyclic olefins include but are not limited to norbornene, norbornadiene, dicyclopentadiene, cyclopentene, cycloheptene, cyclooctene, cyclooctadiene, cyclododecene, 7-oxanorbornene, 7-oxanorbornadiene, and derivatives therefrom. Illustrative examples of suitable functional groups include but are not limited to hydroxyl, thiol, ketone, aldehyde, ester, ether, amine, imine, amide, nitro, carboxylic acid, disulfide, carbonate, isocyanate, carbodiimide, carboalkoxy, and halogen. Preferred cyclic olefins include norbornene and dicyclopentadiene and their respective homologs and derivatives. The use of dicyclopentadiene ("DCPD") is particularly preferred.

The ROMP polymerization of the cyclic monomer may occur either in the presence or absence of solvent and may optionally include formulation auxiliaries. Known auxiliaries include antistatics, antioxidants (primary antioxidants, secondary antioxidants, or mixtures thereof), light stabilizers, plasticizers, dyes, pigments, fillers, reinforcing fibers, lubricants, adhesion promoters, viscosity-increasing agents and demolding enhancers. In addition, formulation auxiliaries may include materials that modulate the activity of the catalyst (e.g. to either retard the activity such as triphenylphosphone or to enhance the activity).

In addition to the use of the present invention in solid rocket motors, the present invention may also be used as part of a hybrid rocket propulsion system where the typical combination of propellants is a solid fuel with a liquid oxidizer. Illustrative examples of suitable oxidizers include but are not limited to liquid oxygen, hydrogen peroxide, and nitrogen tetroxide. A good reference for the design of space propulsion systems is SPACE PROPULSION ANALYSIS AND DESIGN 2nd Ed. by Ronald W. Humble, Gary N. Henry, and Wiley J. Larson, McGraw-Hill Inc. (1995) which is also incorporated herein by reference.

For the purposes of clarity, the specific details of the present invention will be illustrated with reference to particularly preferred embodiments. However, it should be appreciated that these embodiments are for purposes of illustration only and are not intended to limit the scope of the present invention.

Figure 2:
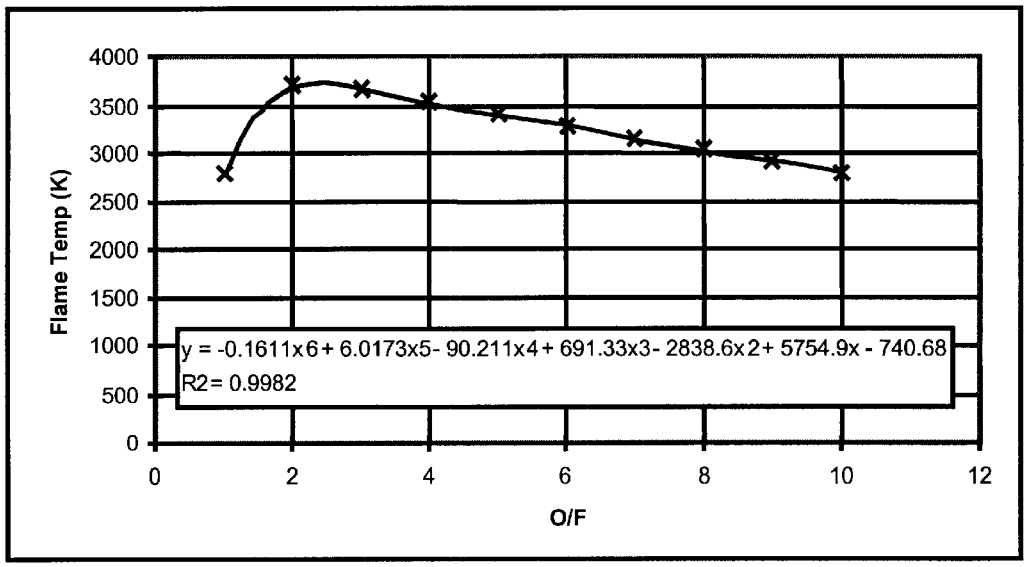
FIG. 2 is a plot of the flame temperature versus mixture ratio for $Li_3AlH_6$ and oxygen.
Figure 3:
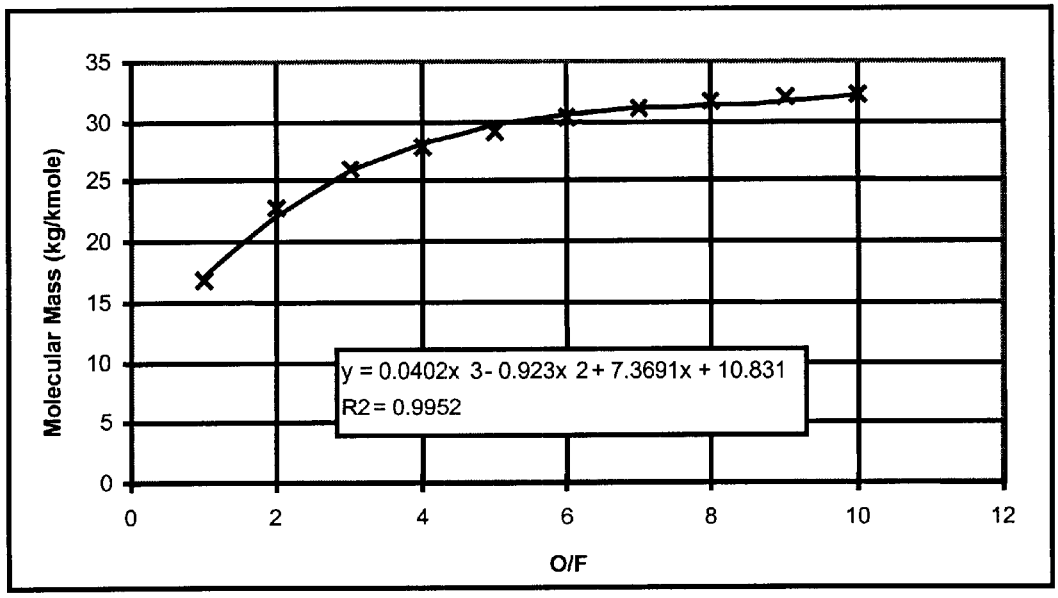
FIG. 3 is a plot of the molecular mass versus mixture ratio for $Li_3AlH_6$ and oxygen.
Figure 4:
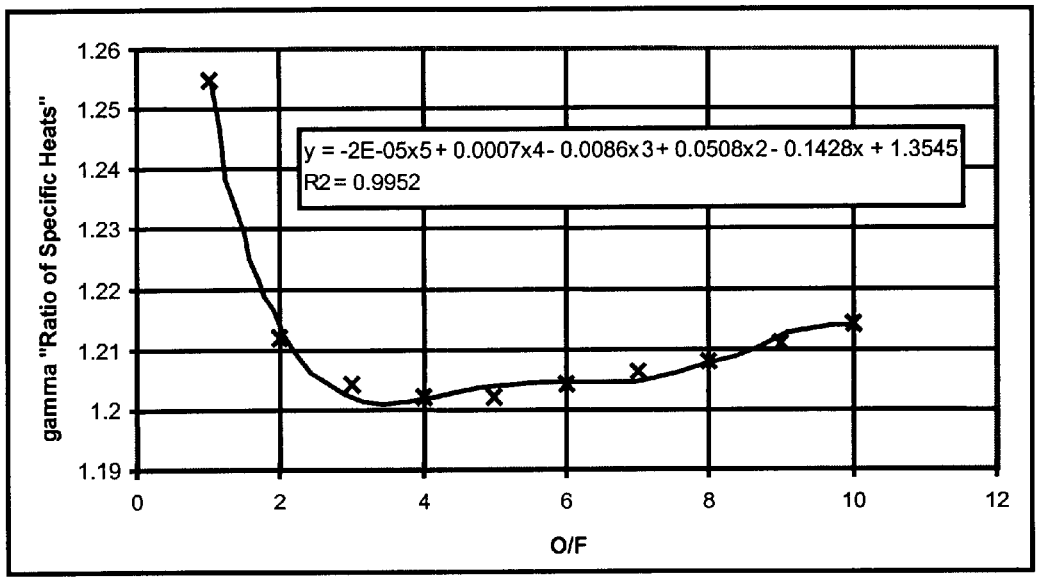
FIG. 4 is a plot of isentropic parameter ($\gamma$) versus mixture ratio for $Li_3AlH_6$ and oxygen.

A series of thermochemistry calculations were performed for $Li_3AlH_6$, a particularly preferred metal hydride for the practice of the present invention. FIG. 1 plots the specific impulse of $Li_3AlH_6$ (labeled as "MH") with oxygen and hydrogen peroxide as a function of mixture ratio. As shown by FIG. 1, $Li_3AlH_6$/DCPD with either hydrogen peroxide or oxygen gives excellent performance and significant improvements in performance over a conventional hydrocarbon fuel, hydroxyl-terminated-polybutadiene ("HTPB"). In fact, HTPB is a popular rocket fuel because it is fairly energetic and extremely safe to handle. For example, studies have shown that even when HTPB is soaked in oxygen, it is not explosive. Also noteworthy are specific impulse values greater than 400 seconds. This threshold is generally considered the Holy Grail of chemical rocket propellants since hydrogen/oxygen and only highly toxic and corrosive propellants have exceeded specific impulse values of 400 seconds. FIGS. 2–4 are graphical representations of various combustion parameters for $Li_3AlH_6$ and oxygen. In particular they show flame temperature, molecular mass of the combustion products, and isentropic parameter ($\gamma$) of the combustion products.

Several tests were conducted using metal hydride/DCPD as a rocket fuel. Initially, two motors using conventional HTPB rubber grain were test fired to obtain baseline thrust data. The fuel was cast into a steel combustion chamber and a ¼" port was drilled down the center of the rubber. The injector and nozzle were clamped in a 4-screw clamp and then the engine was fastened to a thrust stand, instrumented with a force transducer.

After the HTPB test, DCPD (in the absence of metal hydrides) was tested following the same protocol. Although DCPD displayed about the same thrust level as HTPB, the fuel burned at only about one half the rate that HTPB burned. In other words, the combustion was not ideal but this was overcome by a slightly more energetic reaction.

Finally, an engine with DCPD/$Li_3AlH_6$ was tested. However, before the test was conducted, some interesting experiments were conducted with some of the drill shavings. First, some of the shavings were put into water which resulted in hydrogen gas being generated. When a flame was held over the reaction, the gas ignited which confirmed that the hydrogen being liberated was mixing with air resulting in combustion.

In another experiment, a small drop of 85% hydrogen peroxide was added to the DCPD/$Li_3AlH_6$ sample. The addition of the hydrogen peroxide drop resulted in a loud bang followed by combustion. This experiment confirmed that the DCPD/metal hydride fuel is hypergolic. In other words, because the addition of an oxidizer (hydrogen peroxide) will spontaneously ignite the fuel (DCPD/$Li_3AlH_6$), an extra ignition system in the rocket propulsion system is not required.

Although two engines with DCPD/$Li_3AlH_6$ were tested, only one of the tests resulted in any useful thrust data. In the first test, the combustion was so energetic that the steel nozzle literally vaporized in less than 1/10 of a second. Since this steel nozzle had been used in the previous tests, preliminary results with the DCPD/$Li_3AlH_6$ engine indicated that it is a significantly more energetic fuel than HTPB.

Figure 5:
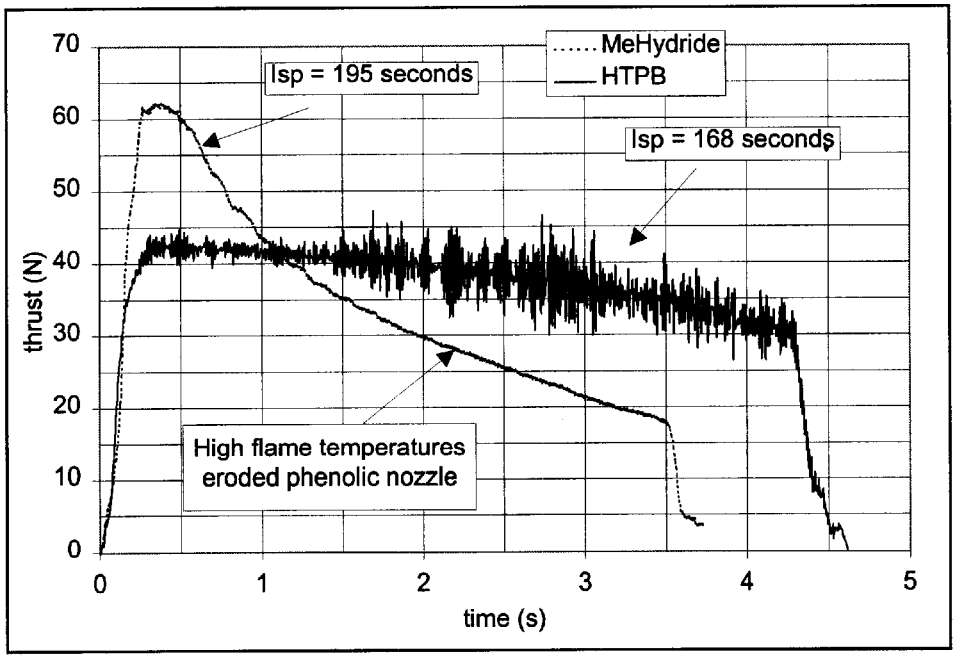
FIG. 5 is a graphical representation of the thrust history of the metal hydride/oxygen engine compared to an HTPB/oxygen engine.

For the second test, the engine was rebuilt using a phenolic nozzle. Although this nozzle was expected to also burn away given the preliminary results of the first test, it was expected to last long enough to obtain some thrust data. The results are shown by FIG. 5. As it can be seen, the thrust level on the DCPD/$Li_3AlH_6$ engine (labeled as "MeHydride") initially rose as the HTPB engine but reached a level which is approximately 40% higher than the peak HTPB thrust level. However, due to the erosion of the phenolic nozzle which allowed the pressure in the combustion chamber to drop, the thrust level for the DCPD/$Li_3AlH_6$ engine quickly dropped off. It is anticipated that the higher thrust levels for the DCPD/$Li_3AlH_6$ engine would be maintain when these tests are repeated with a nozzle that is more thermally stable. In any event, these results are sufficient to demonstrate that DCPD/$Li_3AlH_6$ performs exceedingly well as a rocket fuel.

EXAMPLE 1

To demonstrate the insolubility of metal hydrides in DCPD, 5 g of DCPD monomer (95% purity, Aldrich) and 4 mg catalyst, $(Cl)_2(PCy_3)_2Ru{=}CHPh$ (wherein Cy is cyclohexyl and monomer to catalyst ratio is 7000:1) were first mixed together. Then 2 g $LiAlH_3$ and 2 mg triphenylphosphine ("TPP") were added. The reaction was allowed to proceed for 5 minutes at room temperature and there was no post cure at elevated temperature. The metal hydride did not inhibit polymerization and a high quality poly DCPD plug was produced. After almost two years of aging at room temperature, the quality of the plug remained virtually unchanged.

EXAMPLE 2

Three rocket grains were mixed as indicated by Table 1.

TABLE 1

| DCPD Test # | DCPD monomer (g) | TPP (g) | Catalyst (g) | Carbon Black (g) |
|---|---|---|---|---|
| 1 | 65 | 0.080 | 0.054 | 0 |
| 2 | 65 | 0.041 | 0.055 | 0.599 |
| 3 | 65 | 0.080 | 0.054 | 0.595 |

The indicated mixtures were cast in a pressure-vessel tube to form three rocket fuel plugs. Each plug was burned by injecting gaseous oxygen in one end and ignited using magnesium wire (THERMALITE) and an electric power source. As shown by Table 2, each plug exhibited a regressive rate slightly below standard HTPB fuel but the thermochemistry was substantially the same.

TABLE 2

| | regression rate (in/s) | burn time (sec) |
|---|---|---|
| HTPB Test #1 | 0.081 | 3.5 |
| HTPB Test #2 | 0.090 | 4.3 |
| DCPD Test #1 | 0.049 | 3.2 |
| DCPD Test #2 | 0.038 | 6.5 |
| DCPD Test #3 | 0.050 | 4.0 |

Conclusions are that DCPD will work as a rocket fuel but it does not burn as fast as conventional fuel.

EXAMPLE 3

Two grains using $Li_3AlH_6$ and polyDCPD were made according to the procedure described above using the formulations as shown by Table 3. The catalyst used was $(Cl)_2(PCy_3)_2Ru{=}CHPh$.

TABLE 3

| grain | DCPD (g) | TPP (g) | Catalyst (g) | $Li_3AlH_6$ (g) |
|---|---|---|---|---|
| 1 | 44.550 | 0.0290 | 0.0373 | 11.084 |
| 2 | 50.576 | 0.0313 | 0.0418 | 20.763 |

The rockets were ignited as described above, using gaseous oxygen as an oxidizer. The total burn duration for grain 1 was 3.0 seconds. However, during the testing of grain 1, the strain steel nozzle failed in the first second which hindered the measurements of performance data. The total burn time for grain 2 was 3.72 seconds. The thrust histories for grain 2 and a conventional hydroxyl-terminated polybutadiene ("HTPB")-based grain are shown in FIG. 5. As can be seen in this figure, there is a substantial increase in thrust of grain 2 at the start of the burn compared to the HTPB grain. However, due to the slow erosion of the phenolic nozzle during the burn, thrust for grain 2 quickly drops below that of the HTPB grain.

In the claims:

1. A rocket fuel comprising a metal hydride and a ROMP-derived polymer.

2. The rocket fuel as in claim 1 wherein the ROMP-derived polymer is selected from the group consisting of poly-norbornene, poly-norbornadiene, poly-dicyclopentadiene, poly-cyclopentene, poly-cycloheptene, poly-cyclooctene, poly-cyclooctadiene, poly-cyclododecene, poly-7-oxanorbornene, poly-7-oxanorbornadiene, and derivatives therefrom.

3. The rocket fuel as in claim 1 wherein the ROMP-derived polymer is poly-dicyclopentadiene.

4. The rocket fuel as in claim 1 wherein the metal hydride is an aluminum hydride.

5. The rocket fuel as in claim 1 wherein the metal hydride is a lithium hydride.

6. The rocket fuel as in claim 1 wherein the metal hydride is a lithium aluminum hydride.

7. A rocket fuel comprising poly-dicyclopentadiene and a metal hydride selected from the group consisting of aluminum hydride, lithium hydride, and lithium aluminum hydride.

8. The rocket fuel as in claim 7 wherein the metal hydride is selected from the group consisting of $AlH_3$, $LiAlH_3$, and $Li_3AlH_6$.

9. The rocket fuel as in claim 7 wherein the metal hydride is a lithium aluminum hydride.

10. The rocket fuel as in claim 9 wherein the metal hydride is $LiAlH_3$ or $Li_3AlH_6$.

11. The rocket fuel as in claim 9 wherein the metal hydride is $Li_3AlH_6$.

* * * * *